United States Patent [19]

Penner

[11] 4,120,475

[45] Oct. 17, 1978

[54] BOOK HOLDING APPARATUS

[76] Inventor: Peter P. Penner, 31862 Carlsrue, Clearbrook, B.C., Canada

[21] Appl. No.: 737,739

[22] Filed: Nov. 1, 1976

[51] Int. Cl.[2] ..... A47B 97/04

[52] U.S. Cl. ..... 248/451

[58] Field of Search ..... 248/173, 126, 441 R, 248/451, 453

[56] References Cited

U.S. PATENT DOCUMENTS

| | | | |
|---|---|---|---|
| 359,056 | 3/1887 | Brower | 248/453 |
| 560,465 | 5/1896 | Bostwick | 248/453 |
| 3,817,486 | 6/1974 | Liliequist | 248/467 |

FOREIGN PATENT DOCUMENTS

| | | | |
|---|---|---|---|
| 264,564 | 1/1913 | Fed. Rep. of Germany | 248/453 |

*Primary Examiner*—William H. Schultz

[57] ABSTRACT

A pair ofcylindrical rolls carried by a pair of wire arms having a spring connection to urge the rolls against one another. The rolls are offset from each other so that a book placed between the rolls can be held at a slanting upright position. As a modification, one of the rolls has a center groove to accommodate the protruding back seam of a book; in another modification, the rolls have locking grooves to prevent rotation of the rolls. In yet another embodiment, one edge portion of each of the rolls is bevelled to permit the device to be positioned in a slanting position. In further embodiments, auxiliary supporting members are mounted to one of the rolls.

6 Claims, 13 Drawing Figures

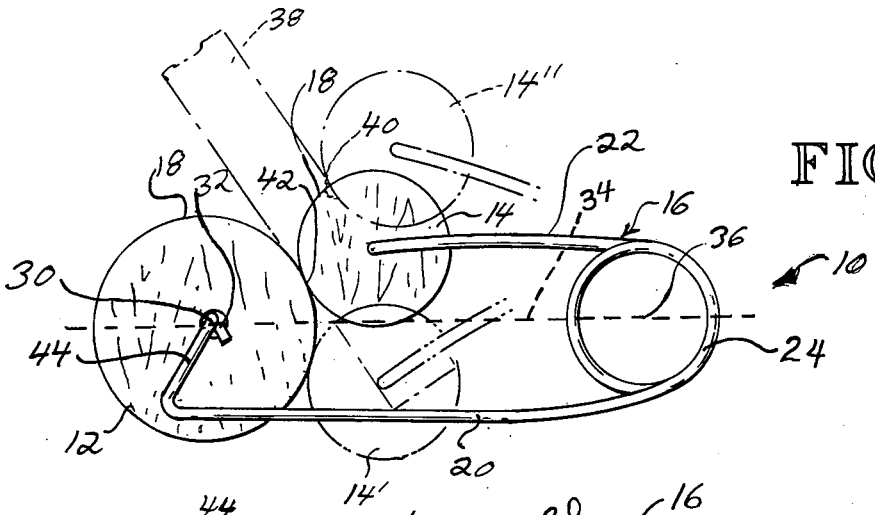
FIG. 1
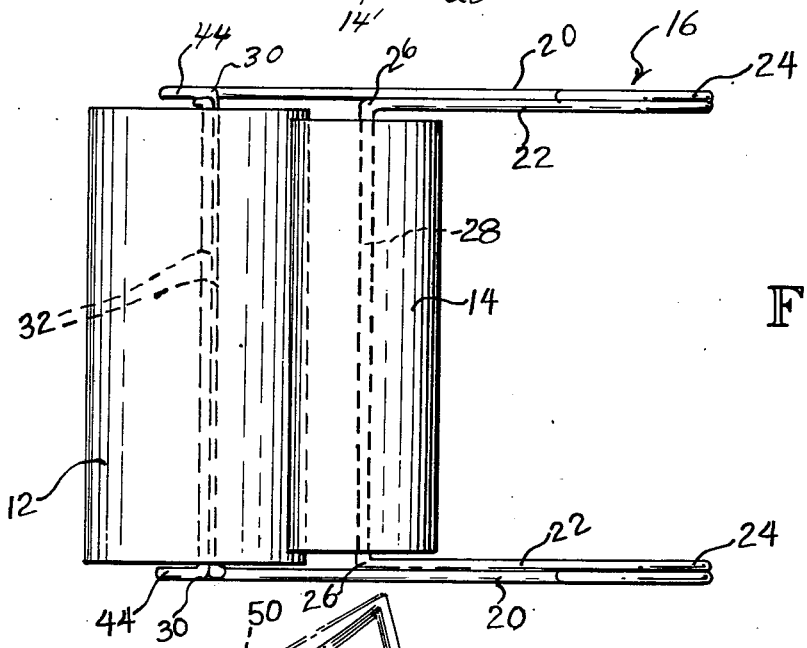
FIG. 2
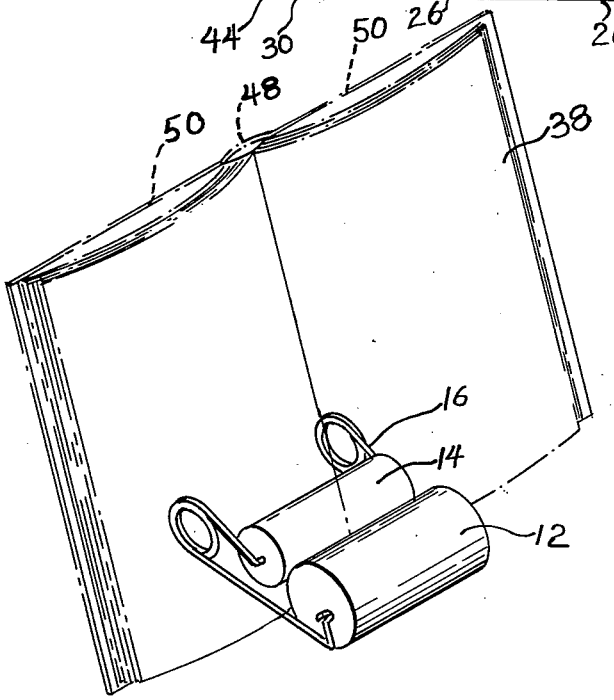
FIG. 3
FIG. 4
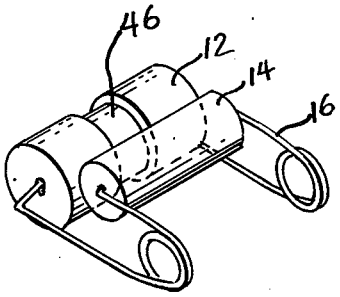

FIG. 5
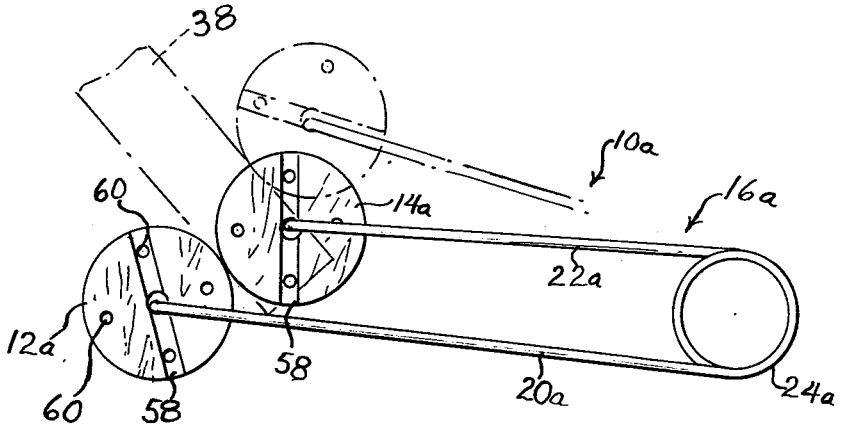
FIG. 6
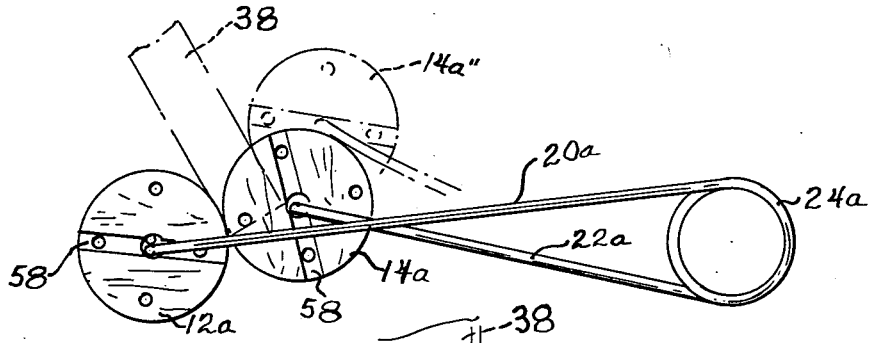
FIG. 7
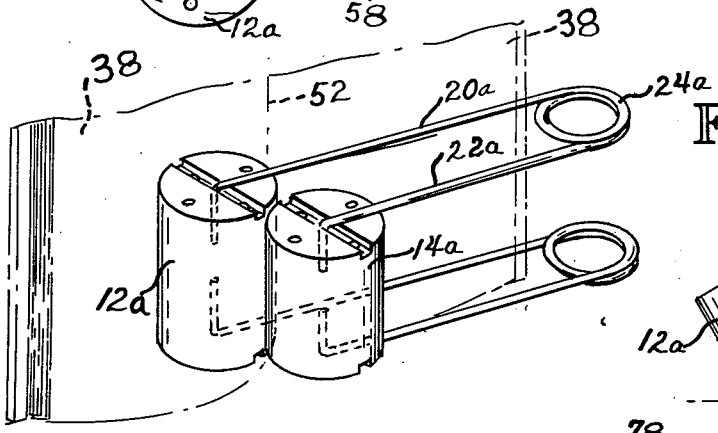
FIG. 8
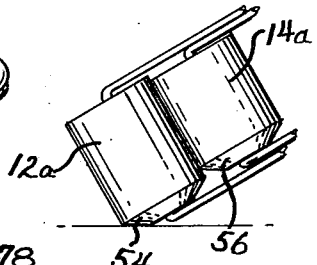
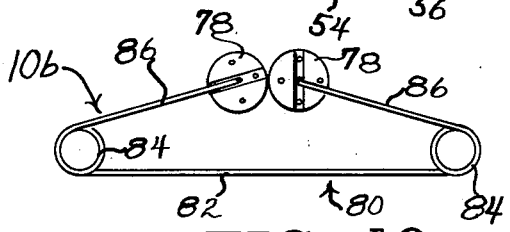
FIG. 10
FIG. 9
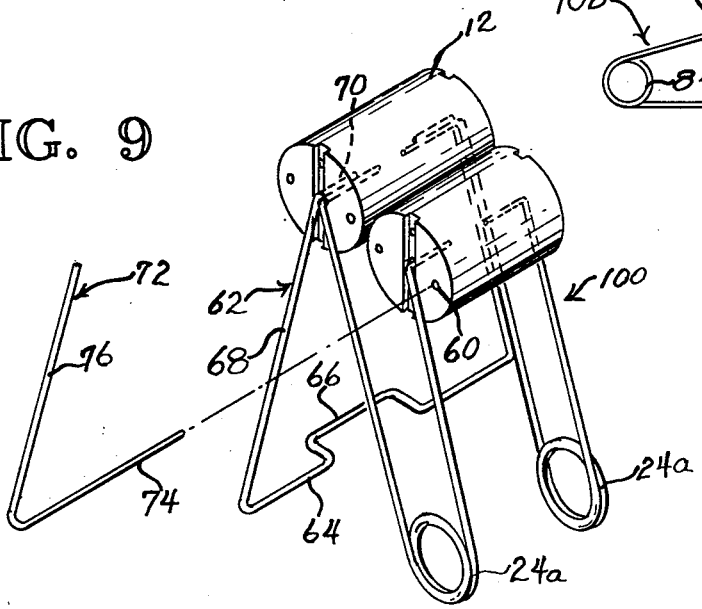

FIG. 11
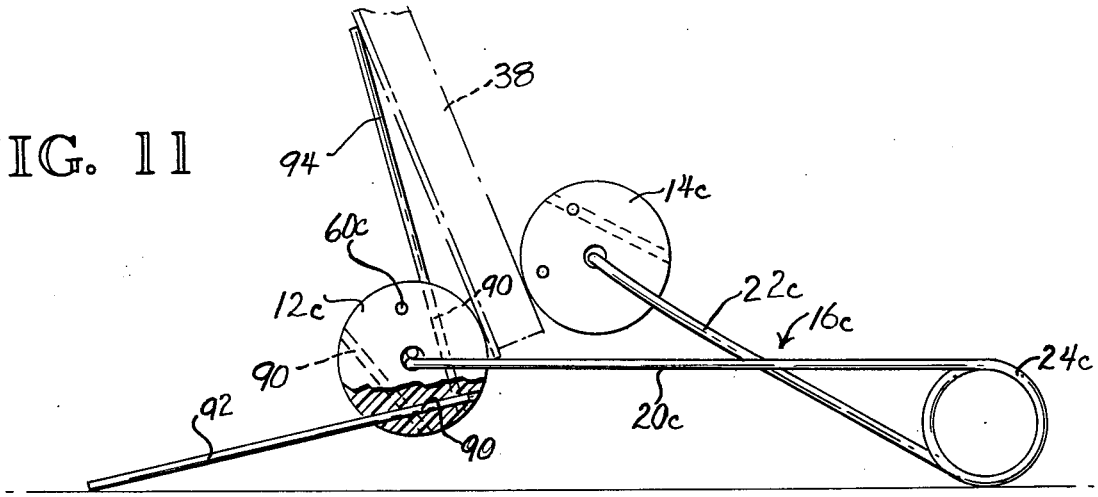
FIG. 12
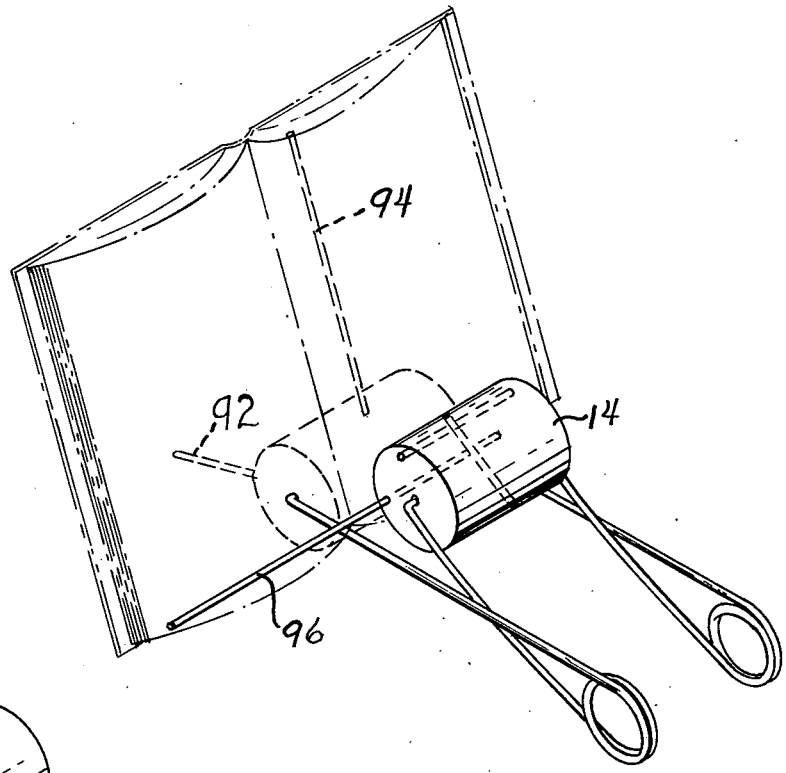
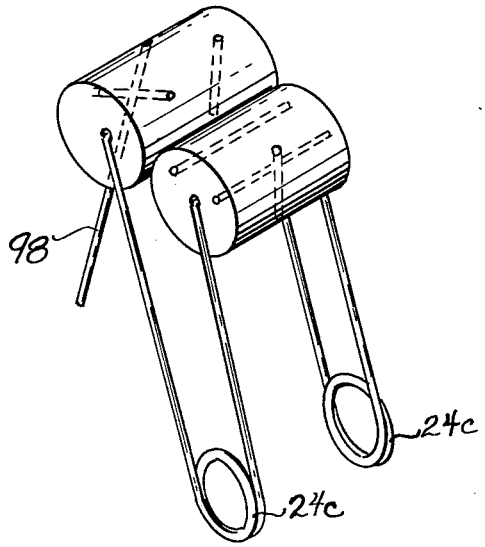
FIG. 13

BOOK HOLDING APPARATUS

BACKGROUND OF THE INVENTION

A. Field of the Invention

The present invention relates to a book holding device particularly adapted for holding a book in a convenient position for reading.

B. Brief Description of the Prior Art

A common prior art apparatus for holding a book is a simple rostrum which provides a slanted surface of approximately the same size of the book, and the book rests on this surface. However, since such devices are somewhat bulky and not readily portable or adaptable for use in a variety of situations, the use of such rostrums is usually limited to use in connection with speaking platforms or in library use with very large books, such as dictionaries.

Consequently, there have been other attempts in the prior art to provide book holders in a more convenient form. For example, in the Hendrix patent, U.S. Pat. No. 331,057, there is shown a book holder in the form of a wire frame which supports a book in somewhat the manner of a rostrum and provides a pair of wire fingers which holds the pages of the book in place. While such a book holder has less bulk than a conventional rostrum, the overall dimensions are still nearly as large as the book which is to be held, and it is limited to holding the book in a single slanted position.

Another approach is shown in the Parker patent, U.S. Pat. No. 294,498, in which there are a pair of arms having a spring interconnection, with a pair of crosspieces mounted at the end of the arms. The crosspieces are slipped over the opposite sides of an open book, thus holding the book in an open position, and there is a U-shaped strut extending downwardly from one of the crosspieces to hold the book at a predetermined slant above a supporting surface.

While the various prior art book holding devices, such as those discussed above, are able to serve a useful support function in holding a book at a convenient reading location, there is still a need for improvement with regard to such things as compactness, versatility, and simplicity of construction. Accordingly, it is an object of the present invention to provide a book holding device which is relatively compact, is versatile in its ability to hold books of various sizes in a variety of positions and yet is relatively simple in its structural design.

SUMMARY OF THE INVENTION

The book holder of the present invention has a mounting frame made up of a base arm and a secondary arm which are interconnected at a rear pivot end of the frame with a spring connection. At the forward contact end of the base arm and the secondary arm, there are mounted to the arms a pair of contact members, desirably in the form of cylindrically shaped rolls. These rolls are offset from one another with respect to a base axis which extends from the pivot end of the base arm to the contact end thereof. The spring connection of the two arms urges the two rolls toward each other in a contact position to hold a book in a reading position at an angle with respect to the base axis.

In a preferred form of the present invention, the secondary roll has a first contact position on one side of the base axis to engage a book at a first angle, and also a second contact position on the opposite side of the base axis to engage a book at a different angle with respect to the base axis. The spring connection is such that it urges the secondary roll to a middle location proximate the base axis so that it can properly perform its holding function in either position. The preferred configuration of these rolls is a generally cylindrical configuration, with the axial length of the cylinder being substantially greater than the width dimension thereof. In a modified form, the contact portions of the rolls, instead of being in a cylindrical curve can be made up of a plurality of flat surfaces, so that the contact member, instead of being a roll, is essentially a prism. Alternately, the basic configuration of the contact member can be partly a cylindrical roll, with only certain protions thereof flattened, either for improved contact with the book or for more stable support on an underlying surface.

In a further modified form, the edges of one or both of the rolls can be bevelled, so that the apparatus can rest at a slant on the bevelled surface and thus hold the book in a desired slanted position.

In a further embodiment, there is a modified form of the wire mounting frame, where there are additionally a pair of elongate support members which rest on an underlying surface. The two mounting arms are then pivotally mounted with spring connections at opposite ends of the base, and extend toward each other to a contact position.

In a further modified form, at least one of the rolls is provided with means to mount one or more supporting struts from at least one roll for additional stability or support. In the preferred form, these are simply provided as holes formed in the roll, some of which are generally transverse to the axis of the roll and at an angle with respect to one another and also angled with respect to the longitudinal axis of the roll. Other holes can be generally parallel to the axis of the roll so that these holes can perform the function of holding the pages of a book open. Also, an auxiliary mounting stand can be provided, this stand being conveniently connected to one of the rolls at the axis of rotation of the roll.

Other features of the invention will become apparent from the following detailed description.

BRIEF DESCRIPTION OF THE DRAWINGS

FIG. 1 is a side elevational view of the first embodiment of the present invention, shown in dotted lines as holding a book in a first position;

FIG. 2 is a top view thereof;

FIG. 3 is a perspective view of the embodiment shown in FIGS. 1 and 2, holding a book in a second position;

FIG. 4 is a perspective view of a modification of the holder shown in FIGS. 1, 2 and 3, where there is a circumferential groove to accommodate the back binding portion of the book;

FIG. 5 is a view similar to FIG. 1 showing a modified form of the present invention;

FIG. 6 is a view similar to FIG. 5, but showing the book holding device of FIG. 5 in a second book holding position;

FIG. 7 shows the device of FIGS. 5 and 6 in yet a third book holding position;

FIG. 8 shows a modified form of the device shown in FIGS. 5 through 7, where edge portions of the contact rolls are bevelled to provide a slanted surface by which the device can be supported from an underlying surface in an angled position;

FIG. 9 shows yet a further modification where an auxiliary supporting frame is provided;

FIG. 10 shows yet another embodiment where there is an additional elongate base frame member to provide greater support from an underlying surface;

FIG. 11 is a side elevational view of a further embodiment, in which additional supporting struts are mounted to one of the contact rolls for additional support of the book and additional support from the underlying surface;

FIG. 12 is a perspective view showing the device of FIG. 11 in a similar position with an additional strut used for holding the pages of the book open; and FIG. 13 shows the device of FIGS. 11 and 12 with a support strut in a different position to hold the device in a more upright location.

DESCRIPTION OF THE PREFERRED EMBODIMENTS

In FIG. 1, there is shown a first form of a book holding device 10, comprising a base contact member 12 and a secondary contact member 14, mounted to a supporting frame 16. In the particular embodiment shown herein, these two contact members 12 and 14 are in the form of elongate cylindrical rolls, mounted for rotation approximately at their center longitudinal axes. However, as will become more apparent in the following detailed description, the rolls 12 and 14 do not have to be perfectly cylindrical, and the axis of rotation can be offset from the longitudinal center axis. Further, while the contact surface 18 of each of the rolls 12 and 14 is shown herein as curved (more precisely, circularly curved), these contact surfaces 18 can be made in part as a flattened surface or as a plurality of flattened surfaces so that the contact members 12 and 14 would be in the form of a right angle prism, as opposed to a cylindrical configuration.

An example of a modified form of the rolls 12 or 14, would be a construction wherein a cross-sectional configuration would be a right-angle hexagonal prism having six flat contact surfaces. Or the surface can be partially flat or partially curved. In particular applications, this may be advantageous, for example, in providing a flat surface for desired ground support, or a flat surface to hold a book at a desired predetermined angle.

The mounting frame 16 is made up of substantially identical right and left sections, and comprises two lower base wire members 20 which collectively form a base arm 20—20 to which the contact roll 12 is mounted, and two secondary wire members 22 which collectively form a secondary arm 22—22 to which the secondary roll 14 is mounted. The right set of arm members 20 and 22 are interconnected at their rear pivot end by means of a coil spring 24, and the left arm members 20 and 22 are similarly connected by a coil spring 24. At the location of the secondary contact roll 14, the forward contact ends 26 of the arm members 22 are interconnected by a rod 28 extending entirely through the contact roll 14 and forming a rotary mounting for the roll 14. The outer contact ends 30 of the two base arm members 20—20 each extend inwardly and through the base roll 12 in the form of rods 32 to provide a rotary mounting for the base roll 12.

To describe the functional relationships of the components of the book holding device 10, this device 10 can be considered to have a base axis, indicated at 34, which extends from the axis of rotation, (i.e., the location of rods 32) of the base roll 12 to the center pivot axis 36 of the two spring members 24. As viewed in FIG. 1, locations above the base axis 34 are considered as "upper", and those below the axis 34 as "lower". Proximity to the rotational axis 32 of the base roll 12 is considered to be the front or forward part of the device 10, and proximity to the pivot axis 36 of the spring members 24 is considered to be at the rear of the device 10.

Before describing the mode of operation of the first embodiment 10, attention should be directed to two key features of this first embodiment 10. First, there is the offset relationship of the two rolls 12 and 14, in which the base roll 12 is at a more forward location. Second, the spring connection 24—24 between the two mounting arms 20—20 and 22—22 is such that the secondary roll 14 is urged to an intermediate location proximate the base axis 34. The effect of this is that the secondary roll 14 has two operating positions. One of these is shown in the full lines at 14 in FIG. 1, and the other operating position is shown in the lower dotted lines at 14' of FIG. 1.

In the position shown in the full lines of FIG. 1, the secondary roll 14 is in its upper position where the spring connection 24—24 urges the upper arm member 22—22 downwardly to push the secondary roll 14 downwardly against the base roll 12. Also, in FIG. 1, the secondary roll 14 is shown as being moved upwardly to an upper dotted line position, indicated at 14", to hold a book, indicated in dotted lines at 38, which is inserted between the two rolls 12 and 14.

Further, as indicated in FIG. 1, the roll 14 can be moved downwardly beneath the base axis 34, as indicated in broken lines at 14' in FIG. 1. The spring mounting of the roll 14 permits the roll 14 to be moved to this position, and in this position, the spring mounting 24—24 urges the roll 14 upwardly toward the base axis 34 so that it pushes in an upward direction against the base roll 12.

With regard to the first operating mode, to place a book in a reading position, the secondary roll 14 is pulled away from the base roll 12, and the book in an open position has its lower end inserted between the two rolls 12 and 14. The secondary roll 14 is released to take the position indicated at 14" in FIG. 1. The secondary roll 14 presses against the book 38 at a contact surface area 40 tangent to the book surface, and base roll 12 presses against the opposite face of the book 38 at a contact area 42 which is a location of tangent contact of the roll 12 with the book 38. It will be noted that due to the offset relationship of the rolls 12 and 14, the planes of the contact areas 40 and 42 are slanted with respect to the base axis 34, so that the book 38 is held at an upwardly slanted angle.

To describe a second operating mode of this first embodiment 10, reference is made to FIG. 3. In this position, the secondary roll 14 is pushed to its lower position indicated at 14' in FIG. 1, after which the roll 14 is pushed further downwardly and away from the base roller 12, and the book 38 inserted therebetween. In this position, the book 38 is held in a more upright position at an angle of greater magnitude with respect to the base axis 34.

As a further feature in the first embodiment shown in FIGS. 1 through 3, it will be noted that the base arm members 20 are offset in a downward direction with respect to the base axis 34, and the two arm members 20 have upwardly extending end sections 44 which in turn connect to the mounting rods 32. This particular arrangment provides a relatively greater unobstructed area between the two rollers 12 and 14, so that the book can be held in either the position of FIG. 1 or that of FIG. 3.

FIG. 4 shows a slightly modified form of the first embodiment 10 shown in FIGS. 1 through 3. As in the first embodiment, there is a base roll 12 and a secondary roll 14 mounted to a frame 16, which is identical in configuration to that shown in FIGS. 1 through 3. Additionally, the base roll 12 is provided with a circumferential groove 46 at the center thereof. The purpose of this groove is to provide space for the rear binding portion 48 of the book 38, so that the two book covers 50 can fit substantially flush against the cylindrical surface of the base roll 12.

A third embodiment of the present invention is shown in FIGS. 5 through 7. Components of the second embodiment which are similar to those of the first embodiment will be given like numerical designations with a "*a*" suffix distinguishing those of the second embodiment. Thus, the holding device 10*a* comprises a base roll 12*a* and a secondary roll 14*a*. The base frame 16*a* comprises base arm members 20*a* and secondary arm members 22*a*, interconnected by a spring mounting 24*a*. However, the base arm members 20*a* are made in a straight line configuration, and do not have the added upright members 44, as in the first embodiment.

With reference to FIG. 5, with the book holding device 10*a* in its first position, the mode of operation is substantially the same as that shown in FIG. 1 of the first embodiment. That is to say, the secondary roll 14*a* is moved upwardly a moderate distance from the base roll 12*a*, the book 38 is inserted therebetween, and the roll 14*a* is released to press the book 38 between the rolls 12*a* and 14*a* to hold the book of a slanting angle with respect to the base axis of the device 10*a*.

With reference to FIG. 6, it will be seen that the second operating position of the device 10*a* is somewhat different than in the first embodiment. When the secondary roll 14*a* is pushed through its center position to the opposite side of the base roll 12*a*, it is positioned on the opposite side of the base arm members 20*a*. Thus, as shown in FIG. 6, to place the book in its engaged position, the roll 14*a* is moved to the position indicated at 14*a*" in FIG. 6 and the book 38 is inserted between the two rolls 12*a* and 14*a* to a position against the base arm members 20*a*. Upon release of the secondary roll 14*a*, the book 38 is held in an upright position at a somewhat steeper angle than that shown in FIG. 5.

FIG. 7 shows yet a third operating mode of this second embodiment. It will be noted that the arm members 20*a* and 22*a* are made somewhat longer than in the embodiment shown in FIGS. 1 through 3. Thus, the two rolls 12*a* and 14*a* can be moved into engagement with the book 38 from a side position. In this position, the two rolls 12*a* and 14*a* engage the book in a manner that the longitudinal axes of the two rolls 12*a* and 14*a* are substantially parallel to the axis 52 of the seam of the book 38.

A modified form of the third embodiment is shown in FIG. 8, where two circumferential side edges of the rolls 12*a* and 14*a* are bevelled, as at 54 and 56. Thus, when the rolls 12*a* and 14*a* are engaged with the book as shown in FIG. 7, by tilting the book holding device 10*a* onto one or the other of the bevelled surfaces 54 or 56, the book can be held at an angle with respect to an underlying supporting surface. If the bevelled surface 54 of the base roll 12*a* is used as the supporting surface, the book, when engaged in the manner shown in FIG. 7, will have its open face slanted upwardly. On the other hand, if the bevelled surface 56 of the secondary roll 14*a* is used as the supporting surface, the open face of the book 38 would be facing moderately downwardly. This would be useful under such circumstances when a person, such as a hopital patient, is lying flat on his back, with a supporting platform moderately above his eye-level. In this location, the book would be held so as to be easily readable to that person. Also, for additional support, the rolls 12*a* and 14*a* could be provided with support struts, as will be shown later herein, with regard to FIGS. 11 through 13.

It will also be noted that in this third embodiment 10*a* shown in FIGS. 5 through 7, there are at the end faces of the rolls 12*a* and 14*a* grooves 58. By aligning one of the grooves 58 with its related arm member 20*a* or 22*a* and shifting the roll 12*a* or 14*a* laterally, the groove 58 will come into engagement with its related arm 20*a* or 22*a*, and thus prevent rotation of the roll 12*a* or 14*a*. In those instances where greater stability is needed in holding the book 38 properly, engagement of the arm member 20*a* or 22*a* with its related groove 58 prevents rotation of the roller 12*a* or 14*a*.

It will also be noted that both of the rolls 12*a* and 14*a* are provided with a plurality of axially aligned holes 60. The function of these holes 60 is to receive a page-holding strut which extends laterally from the roll 12*a* or 14*a* to hold pages of the book in an open position. This particular function will be disclosed more clearly herein in the description of a further embodiment, with reference to FIGS. 11 through 13.

An adaptation of the third embodiment is shown in FIG. 9, where an additional support member 62 is provided. This support member 62 has a generally U-shaped configuration and comprises a base portion 64 having an offset portion 66 to provide better support against an underlying surface, and two upright arm members 68. The arm members 68 have at their ends inwardly protruding fingers 70 which fit into a center axial hole in the base member 12*a*. By use of this support member 62, the book holding device 10*a* can be held in a more upright position, so that it is supported from both the spring members 24 and the auxiliary support member 62.

Also shown in FIG. 9 is a page holder 72 having a right angle configuration. One arm 74 of the page holder 72 is inserted in one of the axially aligned holes 60, and the other arm 76 extends upwardly to engage an open page of the book 38 and hold it in place.

A sixth embodiment 10*b* of the present invention is shown in FIG. 10. In this sixth embodiment 10*b* there are two rolls 78 mounted to a base frame 80. As in the prior embodiments, the frame 80 has right and left sections which are substantially identical. The frame 80 comprises two lower elongate base members 82, each having at opposite ends thereof coiled spring members 84, which in turn connect to mounting arms 86. Each pair of mounting arms 86 engages at its outer ends one of the rolls 78.

Since the mode of operation of this sixth embodiment 10*b* is readily understandable from the description above, it will be reviewed only briefly herein. One or both of the rolls 78 are sprung apart from each other a moderate distance, the book is inserted therebetween, and the rolls are permitted to press against the book to hold it in a reading position. The relatively long base members 80 provides a quite stable support for the holding device 10b with the book mounted therein.

A seventh embodiment 10c of the present invention is shown in FIGS. 11 through 13. This seventh embodiment 10c is substantially similar in construction to the second embodiment 10a, and like components will be like numerical designations, with a "*c*" suffix distinguishing those of the fourth embodiment.

As in the third embodiment there is a base roll 12c, a secondary roll 14c, a frame 16c having base arm members 20c and secondary arm members 22c, connected by spring connections 24c. Also, there are axially aligned holes 60c to receive page holding struts therein. Additionally, in this fourth embodiment 10c, there are transverse holes 90 drilled in both of the rolls 12c and 14c, with these holes 90 being positioned in planes generally perpendicular to the center axis rotation of the related rolls 12c or 14c. These holes 90 are formed at angles with one another, to receive therein struts which then extend from the roll 12c or 14c at angles with respect to one another.

One arrangement of these struts is shown in FIG. 11. There is a first strut 92 which extends forwardly from the base roll 12c to provide base support at a forward location. There is a second strut 94 which extends at approximately right angles to the first strut 92 and is arranged to hold a book 38 in a generally upright position.

This same arrangement is shown in a perspective drawing in FIG. 12, and additionally there is a third strut 96 which extends laterally from the secondary roll 14c to function as a page holder.

A further arrangement of this fourth embodiment 10c is shown in FIG. 13 where one of the struts 98 is positioned so as to be directed downwardly. In this arrangement, the device 10c can be placed in a more upright position, somewhat in the same manner as was done with the device as shown in FIG. 9. This enables the book to be held in a more upright position, with the strut 98 acting as a nearly vertical leg of a tripod in conjunction with the two spring members 24c which act as support members. As a modification, some of the holes 90 can be slanted with respect to the longitudinal axis of the rolls 12c and 14c to slant a pair of struts 98 outwardly.

It is to be understood that the foregoing description is to provide a detailed disclosure of preferred embodiments of the present invention, and is not intended to be limiting, so that modifications of the components of these embodiments could be made without departing from the essential teachings of the present invention.

What is claimed is:

1. A book holding device comprising:

a. a mounting frame having a rear pivot end and a forward contact end, said frame comprising:
   1. a base arm having a pivot end and a contact end, spaced from one another by a first greater base dimension,
   2. a secondary arm having a pivot end and a contact end spaced from one another by a second smaller dimension,
   3. said two arms having a spring connection at the pivot ends thereof to urge the contact ends of the arms toward each other to a contact position,
   4. said mounting frame having a base axis extending from the pivot end of the base arm to the contact end thereof, b. a base contact member mounted to the base arm at the contact end thereof and having a first contact surface adapted to engage one surface of a book at a first contact plane positioned at an angle with respect to said base axis, c. a secondary contact member mounted to the contact end of the secondary arm member at a location rearwardly of the base contact member and having a second contact surface opposing the first contact surface at a second contact plane at an angle with respect to said base axis, said secondary contact member having a first contact position on one side of said base axis to engage a book at a first angle with respect to said base axis, and having a second contact position on the other side of said base axis so as to engage a book at a second angle with respect to said base axis, said spring connection being such as to urge said secondary contact member to an intermediate location proximate said base axis.

2. A book holding device comprising:

a. a mounting frame having a rear pivot end and a forward contact end, said frame comprising:
   1. a base arm having a pivot end and a contact end, spaced from one another by a first greater base dimension,
   2. a secondary arm having a pivot end and a contact end spaced from one another by a second smaller dimension,
   3. said two arms having a spring connection at the pivot ends thereof to urge the contact ends of the arms toward each other to a contact position,
   4. said mounting frame having a base axis extending from the pivot end of the base arm to the contact end thereof, b. a base contact member mounted to the base arm at the contact end thereof and having a first contact surface adapted to engage one surface of a book at a first contact plane positioned at an angle with respect to said base axis, c. a secondary contact member mounted to the contact end of the secondary arm member at a location rearwardly of the base contact member and having a second contact surface opposing the first contact surface at a second contact plane at an angle with respect to said base axis, d. said base member and said secondary member having a generally elongate configuration, with the lengthwise dimensions thereof generally transverse to said base axis, e. at least one of said contact members having interlocking means on one side thereof to become interlocked with its related arm member, to impede relative rotation of said contact member.

3. The device as recited in claim 2, wherein said interlocking means comprises groove means, with said arm being movable into and from said groove.

4. A book holding device comprising:

a. a mounting frame having a rear pivot end and a forward contact end, said frame comprising:
   1. a base arm having a pivot end and a contact end, spaced from one another by a first greater base dimension,
   2. a secondary arm having a pivot end and a contact end spaced from one another by a second smaller dimension, 3. said two arms having a spring connection at the pivot ends thereof to urge the contact ends of the arms toward each other to a contact position,
4. said mounting frame having a base axis extending from the pivot end of the base arm to the contact end thereof, b. a base contact member mounted to the base arm at the contact end thereof and having a first contact surface adapted to engage one surface of a book at a first contact plane positioned at an angle with respect to said base axis, c. a secondary contact member mounted to the contact end of the secondary arm member at a location rearwardly of the base contact member and having a second contact surface opposing the first contact surface at a second contact plane at an angle with respect to said base axis, d. said base member and said secondary member having a generally elongate configuration, with the lengthwise dimensions thereof generally transverse to said base axis, e. said device being adapted to be supported from an underlying surface, said device having support means proximate the pivot end thereof and also proximate the contact end thereof to engage said underlying surface at the front and rear ends of said device.

5. A book holding device comprising:

a. a mounting frame having a rear pivot end and a forward contact end, said frame comprising:
1. a base arm having a pivot end and a contact end, spaced from one another by a first greater base dimension,
2. a secondary arm having a pivot end and a contact end spaced from one another by a second smaller dimension,
3. said two arms having a spring connection at the pivot ends thereof to urge the contact ends of the arms toward each other to a contact position,
4. said mounting frame having a base axis extending from the pivot end of the base arm to the contact end thereof, b. a base contact member mounted to the base arm at the contact end thereof and having a first contact surface adapted to engage one surface of a book at a first contact plane positioned at an angle with respect to said base axis, c. a secondary contact member mounted to the contact end of the secondary arm member at a location rearwardly of the base contact member and having a second contact surface opposing the first contact surface at a second contact plane at an angle with respect to said base axis, at least one of said contact members having additional mounting means by which auxiliary support strut means can be mounted to said contact member, d. said mounting means providing for mounting a strut at a location generally parallelling a lengthwise axis of its related contact member, to provide for holding a book page at an open location.

6. A book holding device comprising:

a. a mounting frame having a rear pivot end and a forward contact end, said frame comprising:
1. a base arm having a pivot end and a contact end, spaced from one another by a first greater base dimension,
2. a secondary arm having a pivot end and a contact end spaced from one another by a second smaller dimension,
3. said two arms having a spring connection at the pivot ends thereof to urge the contact ends of the arms toward each other to a contact position,
4. said mounting frame having a base axis extending from the pivot end of the base arm to the contact end thereof, b. a base contact member mounted to the base arm at the contact end thereof and having a first contact surface adapted to engage one surface of a book at a first contact plane positioned at an angle with respect to said base axis, c. a secondary contact member mounted to the contact end of the secondary arm member at a location rearwardly of the base contact member and having the second contact surface opposing the first contact surface at at second contact plane at an angle with respect to said base axis, at least one of said contact members having additional mounting means by which auxiliary support strut means can be mounted to said contact member, d. said mounting means also comprising holes in said contact member adapted to receive struts therein.

* * * * *